US007367846B1

(12) United States Patent
Yang

(10) Patent No.: US 7,367,846 B1
(45) Date of Patent: May 6, 2008

(54) MULTI-FUNCTION POWER ADAPTOR

(76) Inventor: Hsien-Lin Yang, 6F., No. 3, Lane 68, San Min Rd., Sung Shan District, Taipei City (TW)

( * ) Notice: Subject to any disclaimer, the term of this patent is extended or adjusted under 35 U.S.C. 154(b) by 0 days.

(21) Appl. No.: 11/739,104

(22) Filed: Apr. 24, 2007

(51) Int. Cl.
*H01R 25/00* (2006.01)

(52) U.S. Cl. ..... 439/638; 439/500

(58) Field of Classification Search ..... 439/500, 439/504, 638, 166
See application file for complete search history.

(56) References Cited

U.S. PATENT DOCUMENTS 5,984,731 A * 11/1999 Laity ..... 439/676
6,558,201 B1 * 5/2003 Begley et al. ..... 439/638
6,626,703 B2 * 9/2003 Hsin ..... 439/638
6,769,939 B2 * 8/2004 Neumann et al. ..... 439/709
6,916,208 B2 * 7/2005 Chen et al. ..... 439/639
7,285,023 B1 * 10/2007 Chang et al. ..... 439/638

* cited by examiner

*Primary Examiner*—Khiem Nguyen
(74) *Attorney, Agent, or Firm*—Leong C. Lei

(57) ABSTRACT

The power adaptor contains a body assembly having an indentation for receiving and charging a re-chargeable battery pack. The body assembly also provides a standard USB socket into which a device can be plugged and charged. The charging to the battery pack and through the USB interface can be conducted at the same time. The power adaptor also contains one or more plug members, each having prongs of a specific style or specification. A plug member is detachably joined to the body assembly and, by installing an appropriate plug member, the power adaptor can be plugged into a wall socket of a specific style so as to draw electricity for the charging.

2 Claims, 6 Drawing Sheets

MULTI-FUNCTION POWER ADAPTOR

(A) TECHNICAL FIELD OF THE INVENTION

The present invention generally relates to power adaptors, and more particularly to a power adaptor that can be plugged into various types of sockets and provides USB-based and battery pack charging.

(B) DESCRIPTION OF THE PRIOR ART

Portable consumer electronic devices such as cellular phones, digital cameras, notebook or laptop computers, personal digital assistances (PDAs) have become an indispensable part of people's daily life. All these devices operate from a built-in re-chargeable battery and have a power adaptor as one of the accessories for charging the battery from a wall outlet.

The conventional adaptors have a number of disadvantages. First, the adaptor usually has a plug with prongs of some specific style for plugging into a corresponding styled socket of the wall outlet. When traveling to places using different styled sockets, the user has to carry a separate adaptor which receives the power adaptor's prongs at one end and plugs into the wall socket at the other end. This separate adaptor, usually packaged into a traveler's kit having prongs for different countries, adds to the burden of the user.

Secondly, taking the cellular phone as an example, the cellular phone usually has a removable re-chargeable battery pack that can be taken out from the phone and charged by itself; or can be charged directly when the phone with the battery inside is connected to a power source. As such, usually two power adaptors are required: one having a chamber for the placement and charging of the battery pack (or a backup battery pack); and one having a cable for plugging into a socket of the phone. For the latter, as the connectivity with the personal computer is gaining popularity and as the USB (universal serial bus) interface has become the de-facto standard of computer interfaces, the phone is usually equipped with a cable that can be plugged into a USB socket of the power adaptor. Again, the requirement for two separate adaptors has added significant burden to the user.

SUMMARY OF THE INVENTION

As such, a novel power adaptor is provided to integrate a number of functions usually found on separate adaptors into a single device, so as to obviate the foregoing shortcomings of prior arts.

The power adaptor contains a body assembly having an indentation for receiving and charging a re-chargeable battery pack. The body assembly also provides a standard USB socket into which a device can be plugged and charged. The charging to the battery pack and through the USB interface can be conducted at the same time.

On the other hand, the power adaptor contains one or more plug members, each having prongs of a specific style or specification. A plug member is detachably fixed onto the body assembly and, by installing an appropriate plug member, the power adaptor can be fitted to a specific style of socket of a wall outlet so as to draw electricity for the charging.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
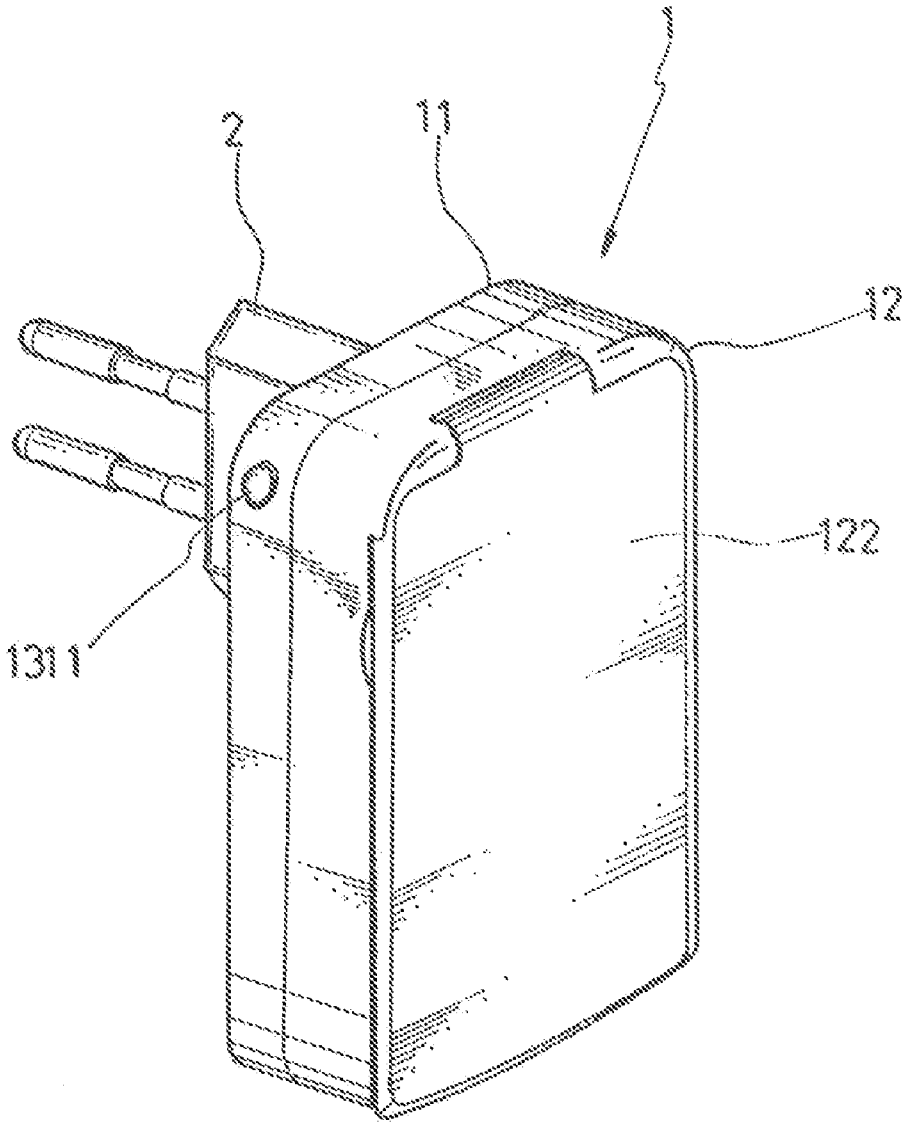
FIG. 1 is a schematic perspective diagram showing a power adaptor according to an embodiment of the present invention.

As shown in FIG. 1, a power adaptor according to an embodiment of the present invention mainly contains a body assembly 1 and at least a plug member 2. The body assembly 1 is formed by joining a front member 11 and a back member 12 together. The plug member 2 is detachably provided on a major surface of the front member 11.

Figure 8:
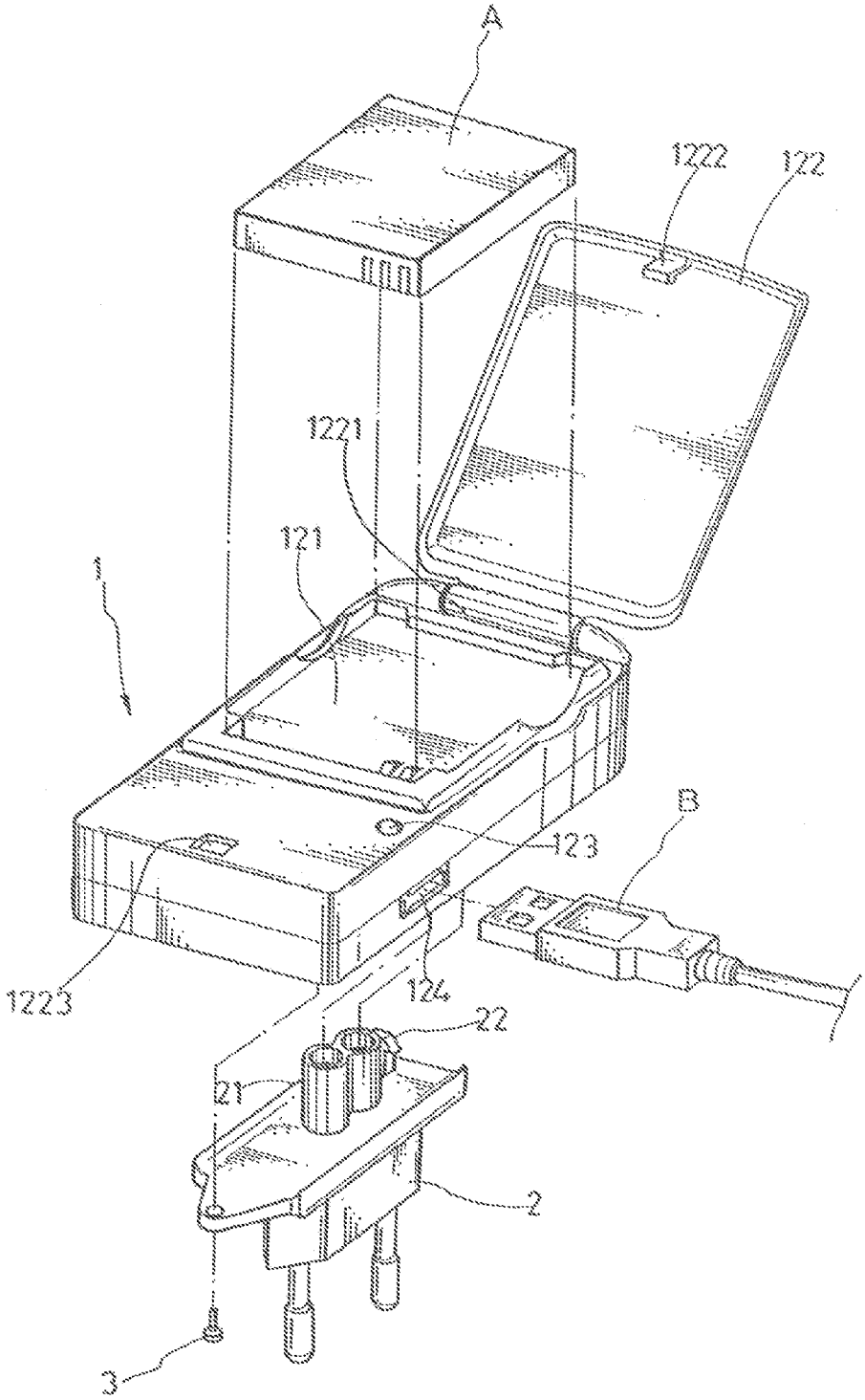
FIG. 8 is a schematic perspective diagram showing application scenarios of the power adaptor of FIG. 1.

As further shown in FIG. 8, the back member 12 contains an indentation 121 for securely accommodating a re-chargeable battery pack A. A cover 122 is pivotally joined to the back member 12 by a hinge 1221 along a side of the indentation 121. A tenon 1222 is provided on a major surface of the cover 12 and, by snapping the tenon 1222 into a socket 1223 on the major surface of the back member 12, the battery pack A is covered up and protected inside the indentation 121. There are electrical contacts (not numbered) in the indentation 121 to establish electrical connection with the electrodes (not numbered) of the battery pack A through which the battery pack A is charged. The back member 12 also contains an indicator lamp 123 for showing the progress or status of the charging to the battery pack A. Along the circumference of the front member 11, a USB socket 124 is provided into which a USB cable from a device to be charged can be plugged. In other words, the power adaptor can also function as a charger to a device capable of being charged through a USB connection.

Figure 3:
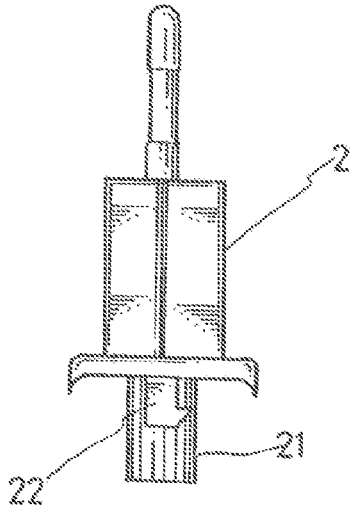
FIG. 3 is a schematic top-view diagram showing a plug member of the power adaptor of FIG. 1.
Figure 4:
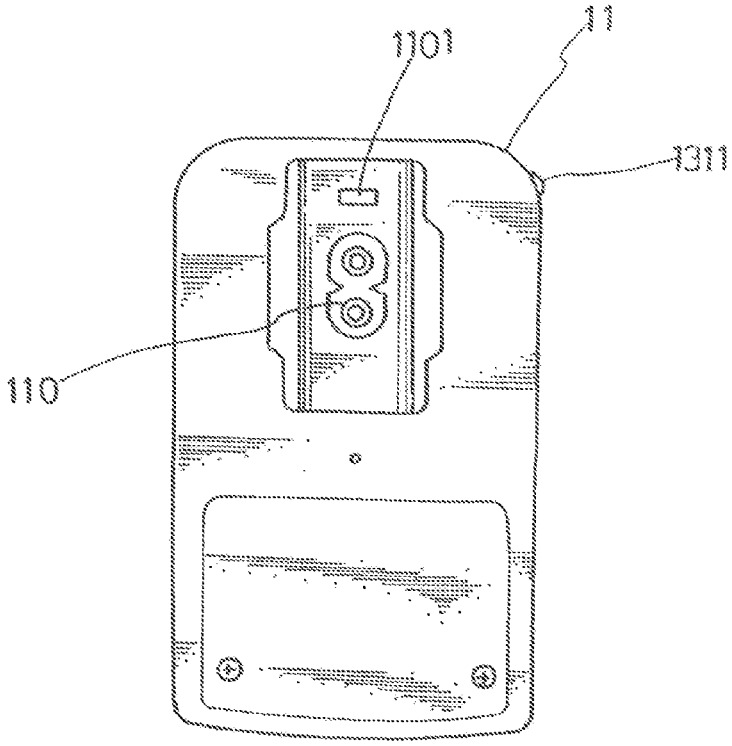
FIG. 4 is a schematic front-view diagram showing the body assembly of FIG. 1.
Figure 5:
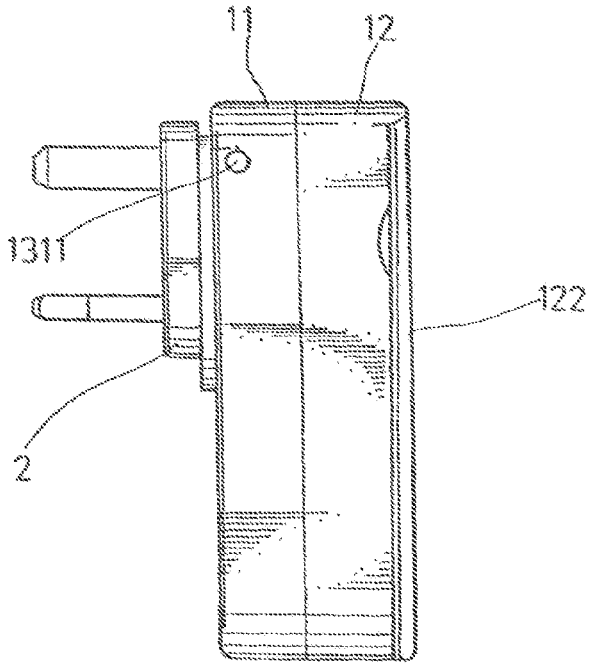
FIG. 5 is a schematic profile-view diagram showing the power adaptor of FIG. 1 configured with another plug member.
Figure 6:
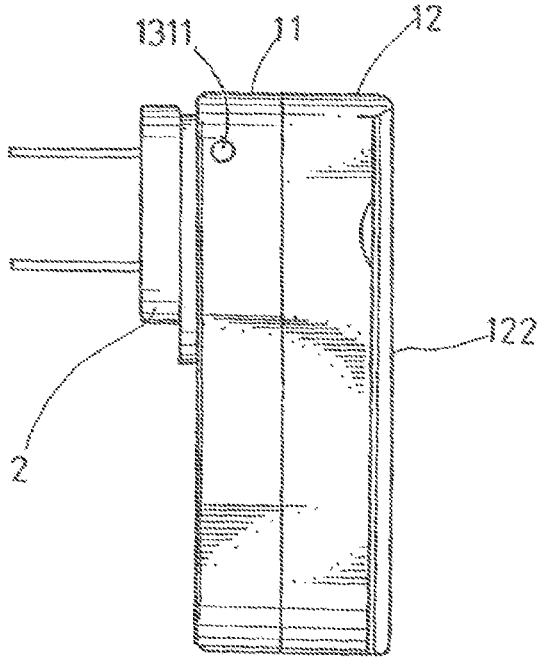
FIG. 6 is a schematic profile-view diagram showing the power adaptor of FIG. 1 configured with yet another plug member.
Figure 7:
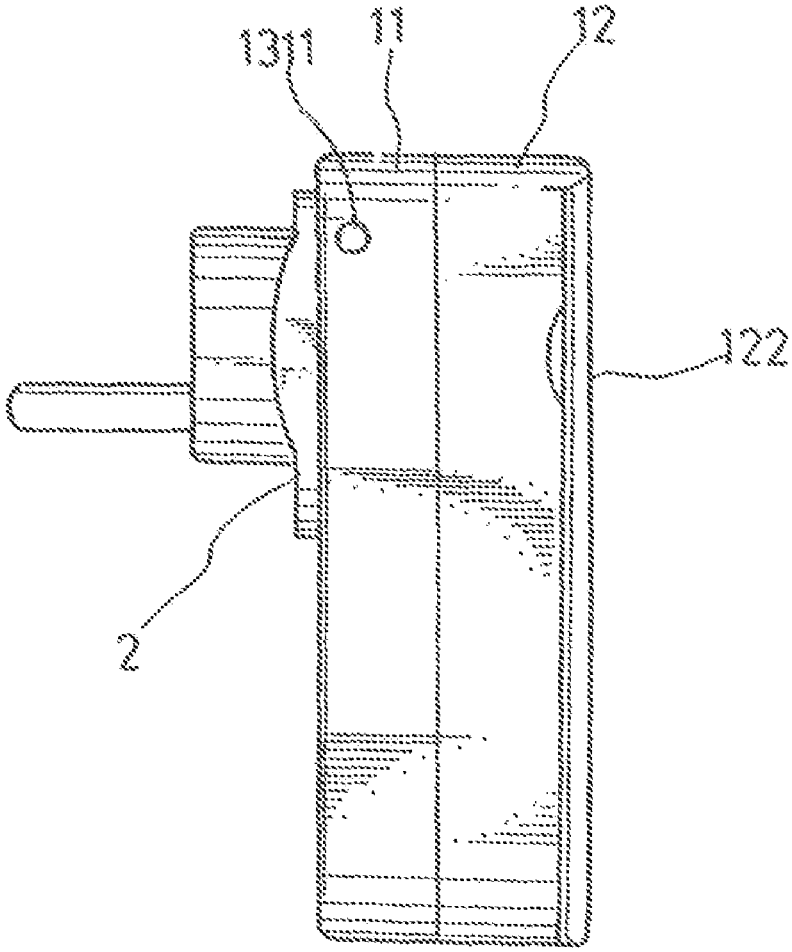
FIG. 7 is a schematic profile-view diagram showing the power adaptor of FIG. 1 configured with still another plug member.

As shown in FIGS. 5 to 7, the power adaptor can contain more than one plug member 2 and each plug member 2 has prongs of a specific style or specification at a front end. As shown in FIGS. 3 and 4, each plug member 2 has a standard plug 21 at a back end for plugging into a socket 110 provided on a major surface of the front member 11. In addition to the plug 21, each plug member 2 also has a tenon 22 that will stick into the front member 11 via a hole 1101 after the plug member 2 is plugged into the socket 110.

Figure 2:
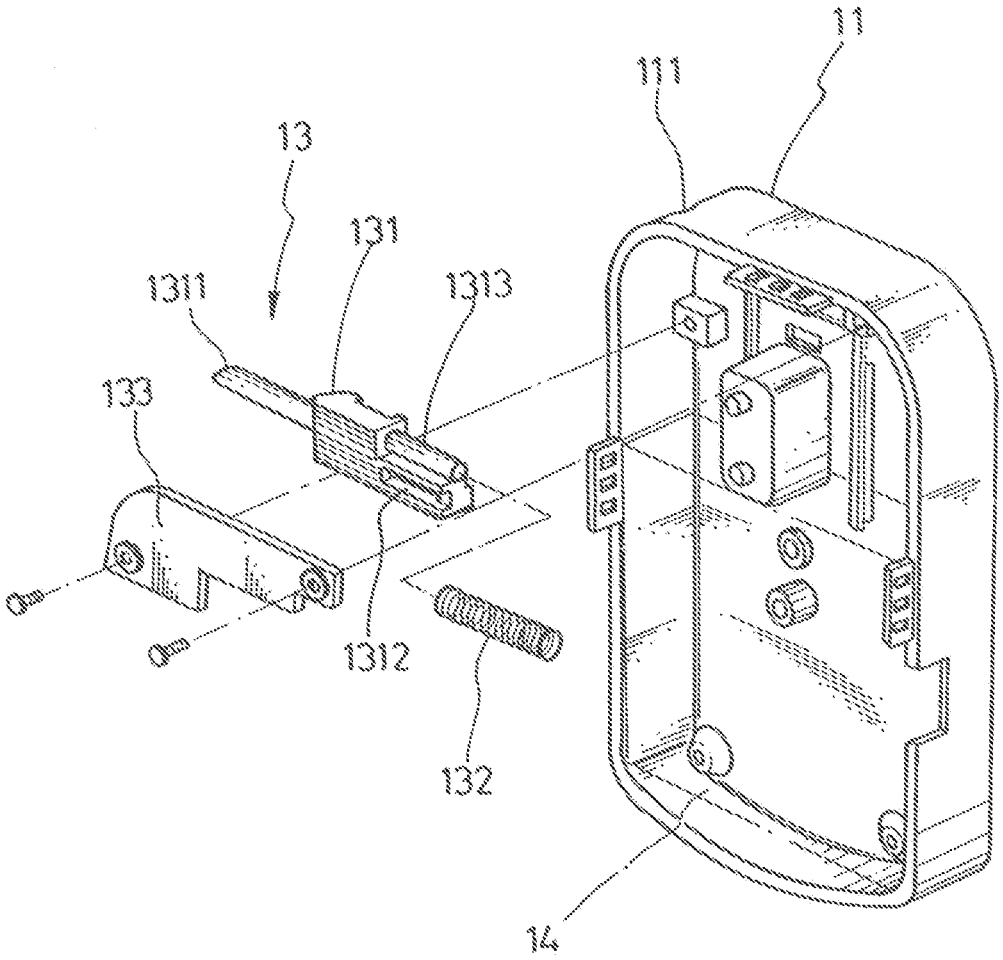
FIG. 2 is a schematic perspective diagram showing the interior of the body assembly of FIG. 1.

As shown in FIG. 2, the tenon 22 will engage a release member 13 housed inside the front member 11. The release member contains a handle 131, an elastic element 132 (such a helix spring), and a positioning element 133. The handle 131 in turn contains a first stick 1311 at one end and a second stick 1313 and a pushing element 1312 at the other end. The handle 131 is positioned horizontally inside the front member 11 and has the first stick 1311 exposed from the circumference of the front member 11 via a hole 111 and the second stick 1313 threaded through the elastic element 132. When the exposed tip of the first stick 1311 is pressed and the handle 13 retreats into the front member 11, the pushing element 1312 presses against the tenon 22 to release the plug member 2 from the socket 110. When the pressure on the first stick 1311 is removed, the elastic element 132 restores the handle 13 back to its original position. The handle 13 is confined by the positioning element 133 so that the handle 13 retreats and restores in a reliable manner.

As shown in FIG. 8, the plug member 2 can be further bolted to the front member 11 by a screw 3 to make the join therebetween even more reliable. Please also note that there are appropriate electronic components hidden inside the body assembly 1 to provide and deliver appropriate DC voltages to the battery pack A and the USB cable B after drawing AC voltages from the plug member 2. These electronic components should be quite common to people of related arts and their details are omitted here for simplicity sake.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A multi-function power adaptor comprising:

a body assembly having a front member and a back member joined together and housing a release member therewithin, said body assembly having a USB socket for charging a device connected via an USB cable, said back member having an indentation on a major surface of said back member for the accommodation and charging of a battery pack, said front member having a socket and a hole on a major surface of said front member; and a plug member having a plurality of prongs on one side, a tenon and a plug on the other side; said plug of said plug member capable of being plugged into said socket while said tenon sticking into said hole of said front member so as to detachably join said plug member and said front member together;

wherein said release member comprises a handle and an elastic element; said handle in turn contains a first stick at one end and a second stick and a pushing element at the other end; said handle has said first stick exposed from said body assembly via a hole and said second stick engages said elastic element; when said first stick is pressed via said hole and said handle retreats into said body assembly, said pushing element presses against said tenon to release said plug member from said socket; and when the pressure on said first stick is removed, said elastic element restores said handle back to its original position.

2. The multi-function power adaptor according to claim 1, wherein said plug member is bolted to said front member by at least a screw.

* * * * *